United States Patent [19]

Mihojevich

[11] Patent Number: 4,545,225

[45] Date of Patent: Oct. 8, 1985

[54] LATCH AND LOCK ASSEMBLY

[75] Inventor: Steven Mihojevich, Elkhart, Ind.

[73] Assignee: Continental Industries, Inc., Elkhart, Ind.

[21] Appl. No.: 524,562

[22] Filed: Aug. 19, 1983

[51] Int. Cl.[4] ..... E05B 65/52

[52] U.S. Cl. ..... 70/71; 70/423; 292/153

[58] Field of Search ..... 70/69–76, 70/370, 423; 292/153

[56] References Cited

U.S. PATENT DOCUMENTS

| | | | |
|---|---|---|---|
| 313,113 | 3/1885 | Schwerin | 70/70 |
| 917,109 | 4/1909 | Neel et al. | 70/70 |
| 2,648,966 | 8/1953 | Polak | 292/153 X |
| 3,245,236 | 4/1966 | Atkinson | 70/71 |
| 3,299,677 | 1/1967 | Gehrie | 70/69 |
| 3,371,511 | 3/1968 | Atkinson | 70/71 |
| 3,452,536 | 7/1969 | Atkinson | 70/70 X |

*Primary Examiner*—Gary L. Smith
*Assistant Examiner*—Lloyd A. Gall
*Attorney, Agent, or Firm*—Marmaduke A. Hobbs

[57] ABSTRACT

A latch and lock assembly for use with suitcases, briefcases and the like having a lower member secured to the case and an upper member secured to the lower member and being axially slidable relative to the lower member for latching and unlatching the case. A male member formed in the upper member is selectively engageable with a female member on the case upon axial movement of the upper member. The upper member is urged toward latched or unlatched positions by a spring disposed against a ramp-like projection on the male member having oppositely beveled sides. Disposed within the upper member is a rotatable lock cylinder urged toward a locked or an unlocked position by a cam follower acting against a resilient cam surface.

10 Claims, 10 Drawing Figures

LATCH AND LOCK ASSEMBLY

BACKGROUND OF THE INVENTION

The latch is the most extensively used part of a suitcase, briefcase, or similar item and, therefore, must be able to provide a long service life while absorbing the stress of closure and repetitious use. Wide variations are found in both the quality and the expense of such latches but all must exhibit positive latching ability and most latches must also exhibit positive locking ability. The latches are normally constructed of metal and many are permanently attached to the case and, as such, are not designed to be replaceable. Broken or deteriorated latches make use of the suitcase or briefcase either difficult or impossible since, in most instances, latching the case is necessary and locking the case may be either necessary or desirable for limiting access to the contents of the case. Thus, the failure or inability to use a particular latch usually leads to the discarding of the particular case and the acquisition of a substitute. This is particularly true with the cases having less expensive latches, as these latches are the ones most likely to fail and most likely to be permanently attached to the case. Even in those cases where the latch is removable without damaging the case, the particular latch required for the case, or a suitable substitute, may not be available. In addition, many latches are specific to either the right or left side of the case, and substitution is not possible.

SUMMARY OF THE INVENTION

It is, therefore, one of the principal objects of the present invention to provide a latch and lock assembly for suitcases, briefcases, and the like which securely latches and locks the particular case and which is durable and affords a long service life.

Another object of the present invention is to provide a latch and lock assembly which is removably mounted on the particular case and which has replaceable component parts which easily and securely snap together.

A further object of the present invention is to provide a latch and lock assembly which is economical to produce, being composed of a plastic material, and which is simple and easy to operate.

A still further object of the present invention is to provide a latch and lock assembly which is easily installed on a suitcase or the like and in which the assembly of the component parts thereof can be made freely interchangeable between the right and left sides of the case.

These and other objects are attained in the present invention which relates to a latch and lock assembly for suitcases, briefcases and the like, one embodiment having a lower member secured to the case and an upper member secured to the lower member and being axially slidable thereon. A male member formed in the upper member is used to engage a female member on the case, and a spring formed in the lower member urges the upper member toward latched or unlatched positions. The spring acts on a ramp-like projection with oppositely beveled sides to urge the upper member in either direction. A lock cylinder having a cam follower formed on its outer surface is rotatable within the upper member for locking or unlocking the latch assembly, and a resilient cam surface in the cylinder mounting hole cooperates with the cam follower to urge the lock cylinder to either a locked or an unlocked position. The lock is inoperable when the assembly is in an unlatched position, due to a bar which prevents movement of the lock cylinder, and an abutment on the lock cylinder cooperates with the bar to prevent axial movement of the upper member when the assembly is in a locked position.

DETAILED DESCRIPTION OF THE PREFERRED EMBODIMENT

Figure 1:
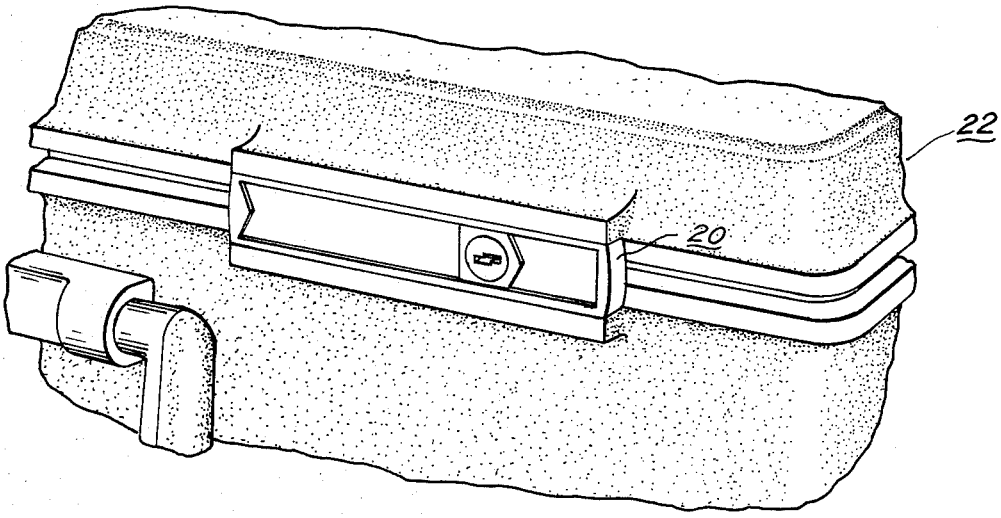
FIG. 1 is a perspective view of the latch and lock assembly embodying the present invention, shown here installed on a suitcase.
Figure 3:
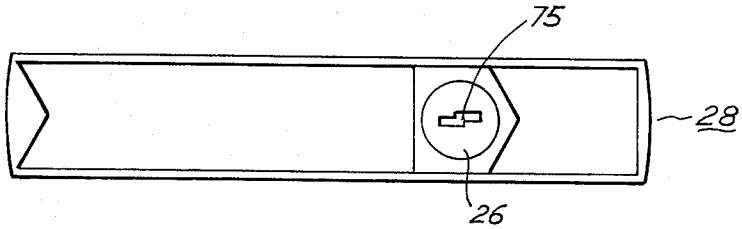
FIG. 3 is a top plan view of the upper member of the latch and lock assembly.
Figure 5:
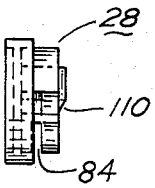
FIG 5 is an end elevational view of the upper member shown in FIG. 4, the view taken from the left side as viewed in FIG. 4.

Referring more specifically to the drawings, and to FIG. 1 in particular, numeral 20 indicates generally the latch and lock assembly embodying the present invention, shown here installed on a suitcase 22. The present invention is suitable for use with a number of different types of suitcases, briefcases and the like, and can be substituted for existing latch assemblies. The suitcase shown is for illustration purposes only and is not meant in any way to limit the scope of the present invention.

Figure 2:
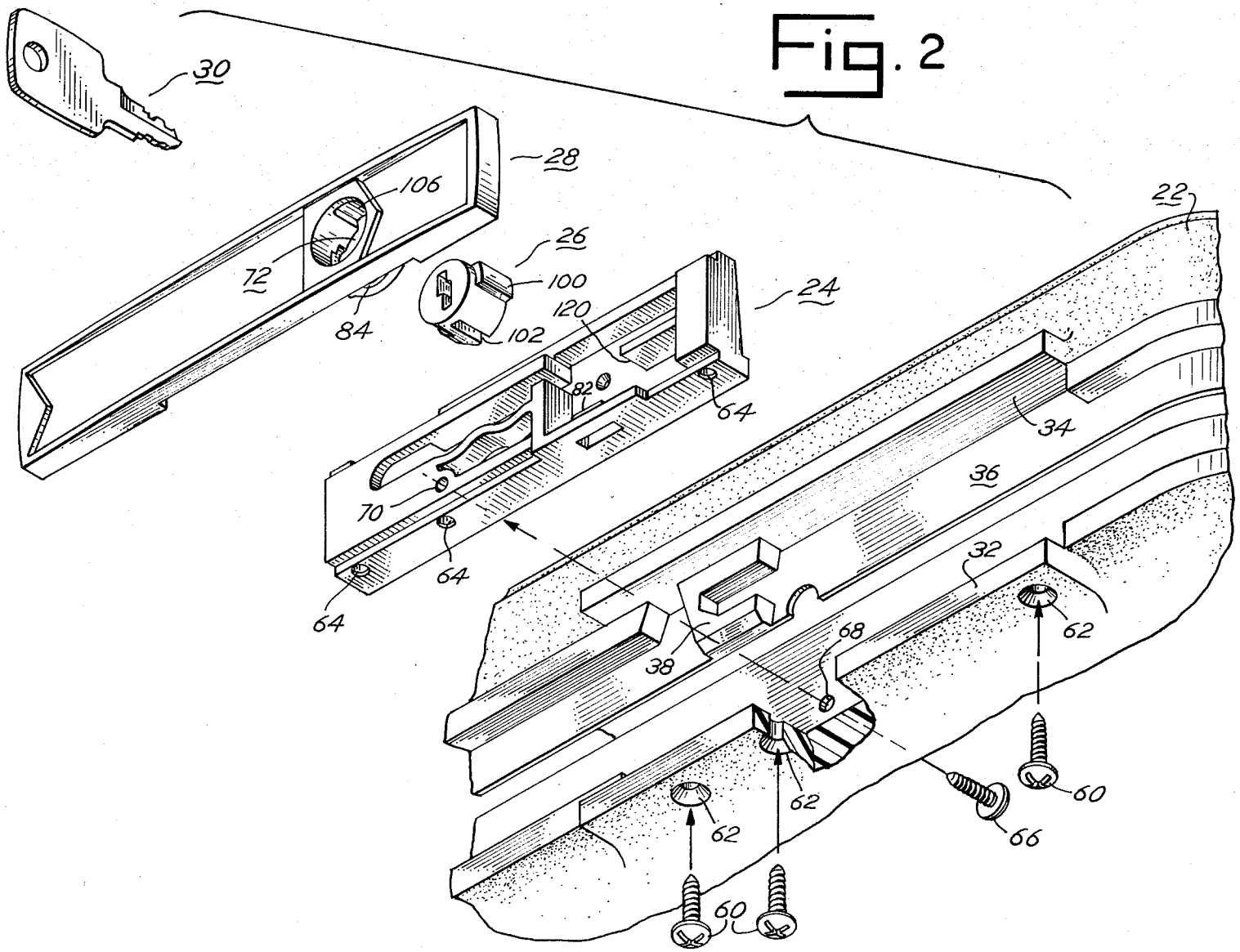
FIG. 2 is an exploded, perspective view illustrating the various parts of the latch and lock assembly.

FIG. 2 illustrates the various parts of the latch and lock assembly including a lower member 24, a lock cylinder 26, an upper member 28, and a double-edged key 30. The suitcase 22 shown here has raised portions or flanges 32 and 34 extending upwardly from the body of the suitcase, thereby providing a recess 36 into which the present invention can be mounted flush with the outer edges of the raised portions. Also shown is a female member 38 into which a male member 40 of the present invention is selectively inserted to latch the case. Lower member 24 is secured to the case 22 by suitable fastening means, such as screws 60, which are inserted through holes 62 in raised portion 32 and into corresponding holes 64 in the lower member, and screw 66 which is inserted through hole 68 in the wall of the case and into hole 70 in the lower member. While it is normally desirable to mount such latch assemblies flush with the outer edges of the case, the present invention may be secured to a case with all of the fastening means extending upwardly through the case and into the bottom of lower section 24, similar to the orientation of screw 66, and raised portions 32 and 34 and recess 36 are not meant to limit the present invention in any way. Similarly, while a female receiving portion for the male member 40 of the present invention, such as female member 38 shown here, must be present in some form, various receiving members having a similar form may be used to accept the male latching member.

Figure 7:
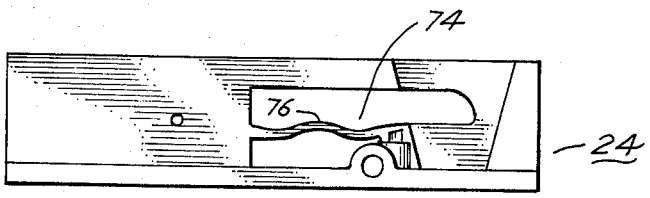
FIG. 7 is a bottom plan view of the lower member of the latch and lock assembly.

The latch and lock assembly of the present invention may be assembled and then mounted on a case, or lower member 24 may be secured to the case before final assembly. In the latter instance, lock cylinder 26 is inserted into a cylinder mounting hole 72 provided in upper member 28. The lock cylinder can be inserted in either of two positions, a locked position or an unlocked position. The upper and lower members are then mated by aligning male member 40 with the opening designated by numeral 74 in FIG. 7 and partially defined by a resilient member such as spring 76. In this pre-assembly position, spring 76 is adjacent an angular surface 78 projecting laterally from male member 40. Slight pressure is then used to snap the upper and lower members together, causing the spring to deflect and to ride over angular surface 78. The spring seats adjacent inner wall 80 of the angular projection of the male member, and an inwardly projecting flange 82 slips into an arcuate slot 84 in the wall of the cylinder mounting hole, thereby securing the members together.

The lock cylinder 26 has an abutment 100 on one side thereof and an axial slot 102 formed in the bottom portion thereof, parallel and partially in communication with keyhole 75 and approximately ninety degrees from the abutment. Approximately ninety degrees from the axial slot and approximately one hundred and eighty degrees from the abutment is a cam follower 104 which projects laterally from the lower side of the body of the lock cylinder. The cylinder mounting hole 72 has a stop 106 formed in the inner wall thereof and a resilient cam surface 108 adjacent arcuate slot 84. The lock cylinder is rotatable within the cylinder mounting hole, having two positions therein. In the first or open position, shown in FIG. 8, the slot 102 is aligned axially with the upper member 28 and with a recess 110 provided in the wall of the cylinder mounting hole. Abutment 100 is disposed adjacent stop 106 in this first position, and cam follower 104 is disposed on the side of the cam surface 108 nearest recess 110. In the second, or locked position, shown in FIG. 9, the lock cylinder is rotated approximately ninety degrees. Cam follower 104 rides on the resilient cam surface 108 which is biased to cause the lock cylinder to assume either the first or second position. The abutment 100 is rotated approximately ninety degrees toward recess 110 and against wall portion 112 of the cylinder mounting hole, which prevents further rotation.

Figure 4:
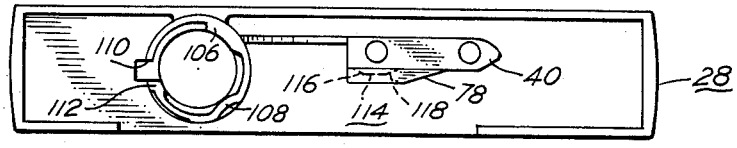
FIG. 4 is a bottom plan view of the upper member shown in FIG. 3.
Figure 6:
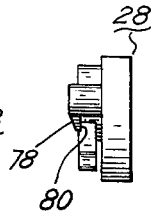
FIG. 6 is an end elevational view of the upper member shown in FIG. 4, the view taken from the right side as viewed in FIG. 4.
Figure 8:
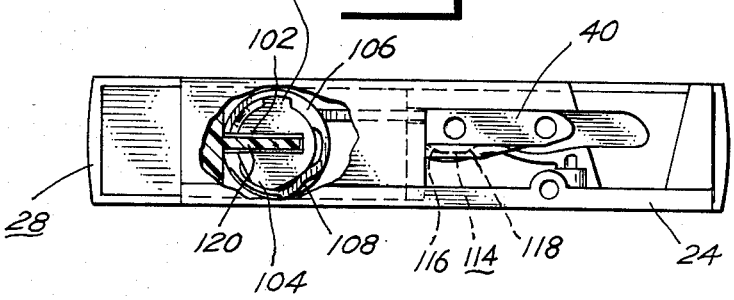
FIG. 8 is a bottom plan view of the assembled latch and lock assembly, with a portion broken away, illustrating the unlatched position.
Figure 9:
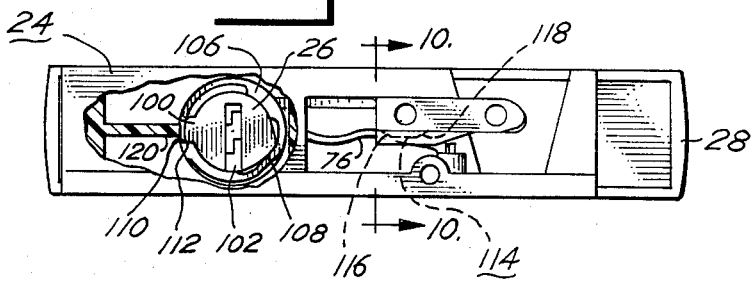
FIG. 9 is a bottom plan view similar to that shown in FIG. 8, here illustrating the latch and lock assembly in a latched and locked position.
Figure 10:
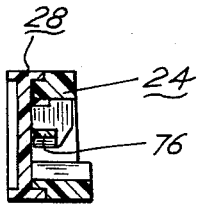
FIG. 10 is a cross-sectional view of the assembled latch and lock assembly, the view being taken on line 10—10 of FIG. 9.

Upper member 28 is axially slidable relative to lower member 24 for latching and unlatching the present invention. Disposed on the outer surface of male member 40 and adjacent inner wall 80 is a ramp-like projection 114, shown in FIG. 4. This projection has oppositely beveled sides 116 and 118, against one of which spring 76 rests. The beveled sides and the rounded surface of the spring facilitate sliding motion in either direction. FIG. 8 shows the present invention in an unlatched and unlocked position with the male member 40 withdrawn and the slot 102 of the lock cylinder aligned axially with the latch assembly. In this position, a bar 120, formed in lower member 24, is projected through recess 110 in the wall of cylinder mounting hole 72 and into slot 102, thereby preventing key entry or locking of the latch assembly while the male member is withdrawn. FIG. 9 shows the present invention in a latched and locked position with male member 40 projecting axially forward to engage female member 38 or a similar receiving member to latch the case. As the upper member is slid toward a latched position, spring 76, shown resting against beveled side 118 in FIG. 8, slides up side 118 and down side 116 where it comes to rest, as seen in FIG. 9. At the same time, bar 120 is withdrawn from slot 102, permitting entry of key 30 and subsequent locking of the latch assembly when desired. The lock cylinder has been rotated ninety degrees to lock the case, as shown in FIG. 9, thus placing abutment 100 in recess 110, preventing axial movement of the upper member relative to the lower member, and securing the case against entry.

In the use and operation of the present latch and lock assembly, as noted earlier, installation on a particular suitcase or briefcase may be accomplished in either of two ways. The assembled latch may be installed as a unit, or lower member 24 may be installed first with the lock cylinder 26 and upper member 28 snapped into place thereafter. The present assembly can be installed on either the right or the left side of the case and, in the event of breakage of one of the members, a replacement member can be easily snapped into place. In an unlatched position, with male member 40 withdrawn from engagement with female member 38, bar 120 is disposed in axial slot 102 in the lock cylinder. This prevents entry of key 30 and prevents movement of the lock cylinder while the case is unlatched. Thus, the case can not be locked in an unlatched position, providing a measure of safety should the key be inadvertently lost. As the upper member is slid axially forward relative to the lower member to latch the case, bar 120 is withdrawn from the lock cylinder and the male member engages the female member. In this position, key 30, designed with equivalent sides for insertion without first orienting the key to meet the design of the lock cylinder, can be used to rotate the lock cylinder and lock the case where desirable or necessary. Retention of the lock cylinder in a selected position is facilitated by the action of cam follower 104 and resilient cam surface 108, which together bias the lock cylinder toward either a locked or an unlocked position. Proper positioning of the upper member relative to the lower member is facilitated by the action of spring 76 on ramp-like projection 114 with its oppositely beveled edges 116 and 118, which together bias the upper member toward a latched or an unlatched position.

While one embodiment of a latch and lock assembly for a suitcase, briefcase, or the like has been shown and described in detail herein, various changes and modifications may be made without departing from the scope of the present invention.

I claim:

1. A latch and lock assembly for use with suitcases, briefcases and the like, comprising a lower member adapted to be secured to the case, an upper member secured to said lower member and having a lock cylinder disposed therein with a radially extending abutment thereon, said upper member being axially slidable relative to said lower member, a male member disposed within said assembly for engaging a female member on the case upon axial movement of said upper member, said male member having a ramp-like projection with oppositely beveled sides mounted thereon, a resilient means disposed against said projection for urging said upper member toward latched and unlatched positions, said lock cylinder having a keyhole axially disposed therein and a radial slot in said lock cylinder disposed parallel and communicating with said keyhole, and a bar on said lower member for engaging said cylinder and preventing axial movement of said upper member when said lock cylinder is in a locked position and for seating in said radial slot and keyhole to prevent entry of a key when said lock cylinder is in unlocked position.

2. A latch and lock assembly as defined in claim 1 in which said resilient means includes a spring disposed within said lower member, said spring having a curved outer surface for slidably engaging said projection.

3. A latch and lock assembly as defined in claim 1 in which said upper member has a means defining a hole for rotatably receiving said lock cylinder, said means including a stop and a resilient cam surface formed in the inner wall of said hole, and a cam follower projecting laterally from the side of said cylinder, for engaging said resilient cam surface and urging said lock cylinder toward locked and unlocked positions.

4. A latch and lock assembly as defined in claim 1 in which said lower member includes an inwardly projecting flange formed therein for securing said lower member to said upper member.

5. A latch and lock assembly as defined in claim 4 in which said resilient means includes a spring disposed within said lower member, said spring having a curved outer surface for slidably engaging said projection.

6. A latch and lock assembly as defined in claim 5 in which said upper member has a means defining a hole for rotatably receiving said lock cylinder and including a stop formed in the inner wall thereof, a resilient cam surface formed in the inner wall thereof, and an arcuate slot adjacent said resilient cam surface for receiving said flange.

7. A latch and lock assembly as defined in claim 6 in which said lock cylinder includes a cam follower projecting laterally from the lower side thereof for engaging said resilient cam surface and urging said lock cylinder toward locked and unlocked positions, and said abutment projects laterally from said lock cylinder on the side opposite said cam follower for engagement by said bar when said lock cylinder is in locked position.

8. A latch and lock assembly for use with suitcases, briefcases and the like having a female member disposed thereon, comprising upper and lower members secured together with said lower member being secured to the suitcase and said upper member being axially slidable relative to said lower member, a male member formed in said upper member for engaging the female receiving member on the case, a rotatably mounted lock cylinder disposed within said upper member for locking and unlocking said assembly, a keyhole axially disposed in said lock cylinder, a radial slot in said lock cylinder disposed parallel and communicating with said keyhole, and a bar on said lower member for engaging said cylinder and preventing axial movement of said upper member when said lock cylinder is in a locked position and for seating in said radial slot and keyhole to prevent entry of a key when said lock cylinder is in an unlatched position.

9. A latch and lock assembly as defined in claim 8 in which said upper member has a means defining a hole for rotatably receiving said lock cylinder and including a stop and a resilient cam surface formed in the inner wall of said hole, and a cam follower projecting laterally from the side of said cylinder for engaging said resilient cam surface and urging said lock cylinder toward locked and unlocked positions.

10. A latch and lock assembly as defined in claim 8 in which said lock cylinder includes an abutment projecting laterally from one side thereof, and said bar engages said abutment when said lock cylinder is in a locked position for preventing axial movement of said upper member.

* * * * *